United States Patent [19]

Cook

[11] Patent Number: 4,516,114

[45] Date of Patent: May 7, 1985

[54] MAGNETIC LOCKING STATUS DETECTION SYSTEM

[75] Inventor: Robert C. Cook, Redondo Beach, Calif.

[73] Assignee: Securitron-Magnalock Corp., Torrance, Calif.

[21] Appl. No.: 473,010

[22] Filed: Mar. 7, 1983

[51] Int. Cl.[3] ..... G08B 13/08

[52] U.S. Cl. ..... 340/542; 340/547

[58] Field of Search ..... 340/542, 547, 567, 551; 73/DIG. 3; 361/143; 324/260; 70/91; 292/251.5; 335/253, 254, 285, 286, 289

[56] References Cited

U.S. PATENT DOCUMENTS

| | | | |
|---|---|---|---|
| 2,508,305 | 5/1950 | Teetor | 292/251.5 |
| 2,690,348 | 9/1954 | Teetor | 335/285 X |
| 2,690,349 | 9/1954 | Teetor | 335/285 X |
| 3,060,370 | 10/1962 | Varterasian | 73/DIG. 3 |
| 3,312,492 | 4/1967 | Remhof | 292/251.5 X |
| 4,287,512 | 9/1981 | Combs | 73/DIG. 3 X |

*Primary Examiner*—Charles A. Ruehl
*Assistant Examiner*—Chi K. Lau
*Attorney, Agent, or Firm*—Poms, Smith, Lande & Rose

[57] ABSTRACT

Magnetic door locks characteristically include a high strength electromagnet and a mating plate made of magnetically permeable material, or door strike, mounted on the door frame and the door, respectively. In addition, in order to determine whether the door strike is in engagement with the electromagnet, detection arrangements are provided; and in the present case, simplified detection arrangements are provided by separate portions of the electromagnetic core separated by non-conducting shims or the like, and the closing of a detection circuit extending between the two portions of the electromagnetic core by the magnetic and electrically conducting door strike bridging between the two sections of the core. In addition, the detection circuit may be electrically connected in parallel with electromagnet energization circuit, to positively indicate both that the electromagnet is energized and that the door is closed.

10 Claims, 5 Drawing Figures

MAGNETIC LOCKING STATUS DETECTION SYSTEM

FIELD OF THE INVENTION

This invention relates to electromagnetic locking apparatus and systems of this type, particularly for doors, gates or the like, and including arrangements for determining the status of the magnetic lock.

BACKGROUND OF THE INVENTION

As indicated, for example, in U.S. Pat. No. 4,287,512, granted Sept. 1, 1981, and entitled "Magnetic Locking Methods And Apparatus", magnetic door locking arrangements have been proposed heretofore, and as one aspect of these systems it is desirable to determine whether or not the door is open or closed, and correspondingly, whether or not the magnetic strike plate is in engagement with the electromagnet, or is properly coupled with the electromagnet rendering the door properly locked. In U.S. Pat. No. 4,287,512, this is accomplished through the use of a Hall effect element which detects the level of the magnetic flux in the electromagnetic core.

The approach disclosed in U.S. Pat. No. 4,287,512, however, suffers from one major and serious drawback: its complexity. An electromagnetic lock is fundamentally a simple device. It basically consists of a coil and a magnetic core normally potted within a casing, and a strike plate. Such a devie is rugged, reliable, inexpensive, and capable of being operated by a wide range of unregulated voltages. When a Hall effect generator is introduced into such a device, several problems result. First, the Hall effect generator requires a regulated voltage, which is not a requirement of the magnet itself and therefore introduces significant additional costs. Second, the output of the Hall generator is a varying weak low-voltage signal, which must be amplified before it can be put to use. The Hall generator chips themselves must, therefore, be accompanied by a large number of additional components to function properly. Any of these components may fail, and such failure will require taking the lock out of service, which will present the owners with repair problems. Moreover, the structure as shown in the above patent envisions the Hall generator as being within the electromagnet and the associated driving and amplifying circuitry being housed in a separate box. The cost of purchase and installation of the separate box is a strong negative relative to the approach disclosed in the above patent. Accordingly, although the electronics box itself is repairable, the Hall generators are typically potted within the lock and as such are unrepairable.

An additional disadvantage of the Hall generator approach is that its final output is a voltage signal. Most users of magnetic locks in buildings prefer an isolated contact closure signal, because this corresponds to existing practice in determining the status of doors. Commonly, within commercial buildings and many homes, magnetic contact switches are placed on each door, such that if the door is closed, the switch will be closed; and the switches may be connected in series. Some type of central panel, then, typically monitors all the doors by putting out a low current signal. If the signal returns to the panel, all the switches which are wired in series must be closed. If the signal does not return, one of the doors is open. It is, therefore, desirable that door status sensing employed with magnetic locks be available in contact closure form, so that it will be compatible with existing facility control panels. To obtain such a contact closure signl from a Hall effect device, an electromechanical relay must be added, following amplification, and this introduces further cost and unreliability.

Other prior art alternatives include the use of snap-action microswitches embedded in the face of the magnet so that, when the strike plate closes against the magnet, the switch is activated; and magnetically activated reed switches embedded in the magnet to be activated by a permanent magnet embedded in the strike plate. These techniques have two main drawbacks. First, and most seriously, they are relatively insensitive. More specifically, they will respond to the presence of the strike plate near the magnet face even if a substantial air gap is present. In the case of the snap-acting microswitch, a substantial amount of non-permeable material may introduce an air gap between the magnet and the strike plate, and the switch will still be activated. Similarly, in the case of the reed switches, they typically trigger when the strike plate approaches within one-quarter inch of the magnet face. Attempts to position the reed switch farther from the corresponding magnet in the strike plate in order to increase its sensitivity will cause it to function erratically or not at all. Reed switches are, by their nature, incapable of precise action. These deficiencies mean that a person could defeat the action of the electromagnet and strike plate by inserting a relatively thin layer of cardboard or the like so that the door could still be opened at will, while an indication of full closure would be sensed.

A second significant limitation on this type of switch is that reed and snap switches, being electromechanical devices, often fail and require replacement, particularly when they are subjected to shock; and this is a frequent occurrence in the use of a magnetic door lock since the strike plate is intended to slap against the magnet face. Although the reliability of snap-acting switches and reed switches are adequate for many applications, their use in magnetic locks seriously degrades the utility of the magnetic locks. More specifically, magnetic locks by their nature possess no moving parts and have theoretically unlimited lives, and are mounted in a strong and permanent fashion so as to resist tampering by vandals. The presence of internal components such as snap-acting switches or reed relays introduces parts which may easily fail or go out of adjustment, and thus significantly reduces the utility and value of the electromagnetic locking systems.

Accordingly, a principal object of the present invention is to overcome the problems and difficulties encountered heretofore with magnetic lock status detection arrangements such as those outlined hereinabove, and, more particularly, to provide a simple, economical and reliable magnetic lock status detector which is not an electronically sensitive component and which does not have any moving parts.

SUMMARY OF THE INVENTION

In accordance with the present invention, the electromagnetic core structure of an electromagnetic door lock is separated into at least two portions by non-conducting shims or spacers. Further, the status detection circuit is connected to these two separate portions of the electromagnetic core, so that when the strike plate engages the two separate portions of the core, it will also close the detection circuit and provide a positive indication that this action has occurred.

As a subordinate aspect of the invention, in one embodiment the detection circuit may be energized when the electromagnet is energized so that, in addition to determining that the strike plate is in engagement with the electromagnet, the output from the status detection circuit will also indicate that the electromagnet is powered.

In accordance with other subordinate aspects of the invention, the electromagnetic core structure may be laminated so that the nonconducting shims are not easily visible from the exposed face of the electromagnet. As another alternative, exposed conductors, preferably having an appearance similar to that of the exposed magnetic core structure, may be provided at two spaced areas on the face of the potted electromagnet, and these two conductors may be bridged by the strike plate.

Other objects, features and advantages of the invention will become apparent from a consideration of the following detailed description and from the accompanying drawings.

DETAILED DESCRIPTION

Figure 1:
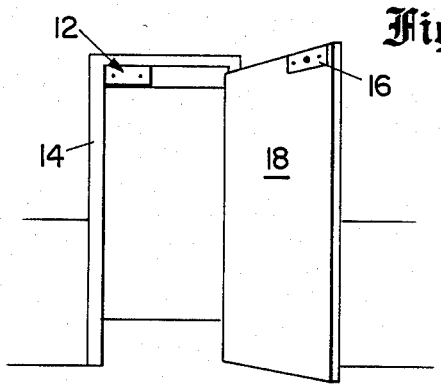
FIG. 1 illustrates a typical installation of an electromagnetic lock on a door.

Referring more particularly, to the drawings, FIG. 1 shows a typical electromagnetic locking installation including an electromagnet 12 mounted on the door frame 14, and a strike plate 16 mounted on the door 18.

Figure 2:
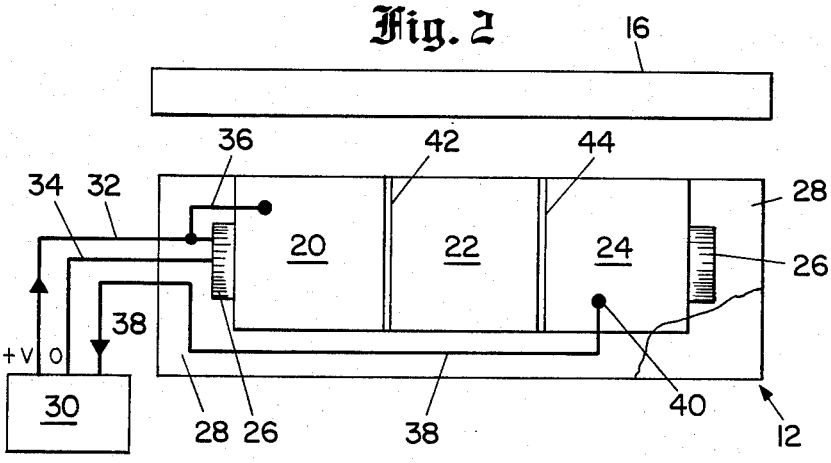
FIG. 2 is a diagramatic showing of an electromagnet, a strike plate, and a detection circuit illustrating the principles of the invention.
Figure 3:
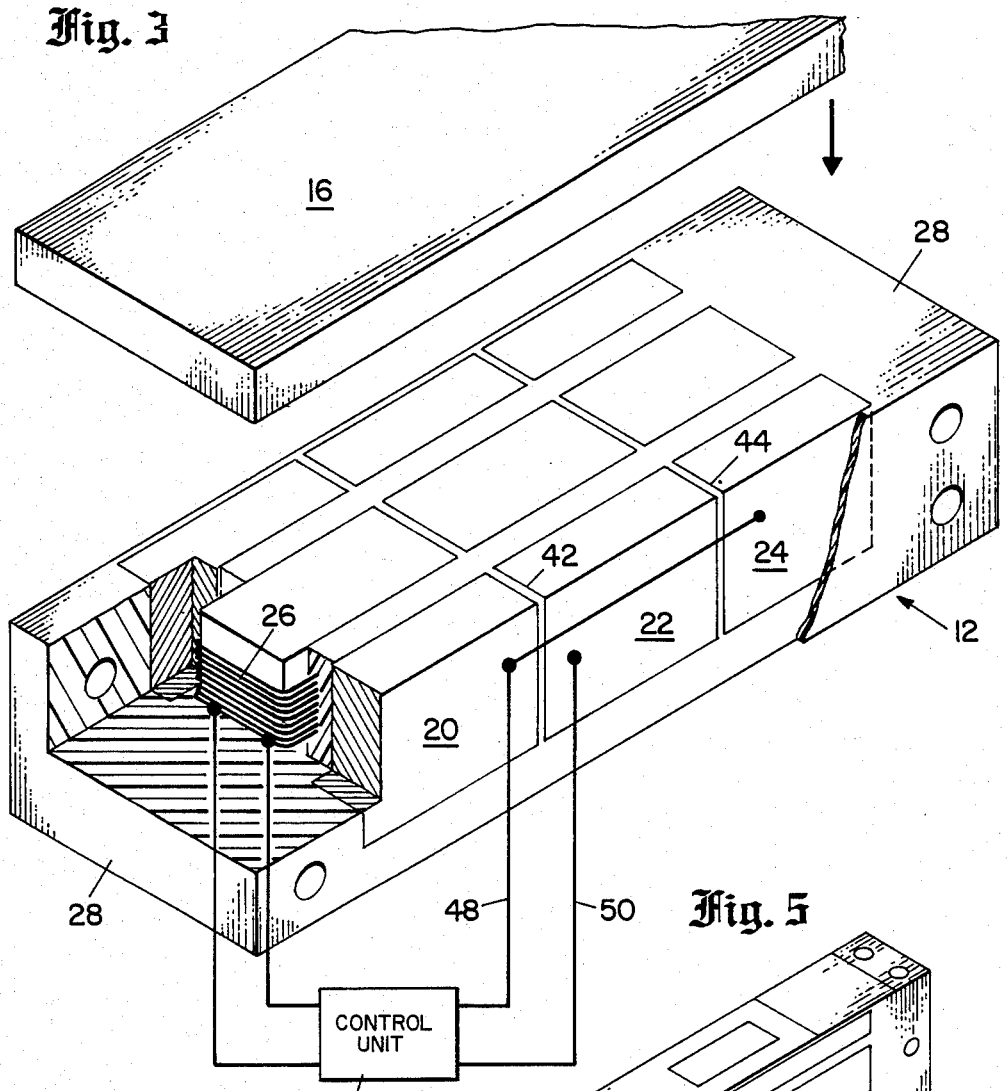
FIG. 3 is a cutaway view of another embodiment of the invention.

FIGS. 2 and 3 are side, and perspective, views, respectively, of the same type of electromagnet 12 and stike plate 16, but with somewhat different control circuits. In both FIG. 2 and FIG. 3, the E-shaped magnetic core is made up of three sections, 20, 22, and 24. A single energizing coil 26 encircles the central legs of the E-shaped cores of all three portions 20, 22, and 24 of the unit. The entire electromagnet assembly is potted in a high-strength plastic casing 28 with the faces of all three of the E-shaped portions of the magnetic core being exposed in opposition to the magnetic strike plate 16.

A control and power supply unit 30 is provided for each of the two systems, and this may be generally of the types used heretofore.

In the system of FIG. 2, the coil 26 is powered from the leads 32 and 34, and lead 34 may, for example, be the ground lead, and power may be supplied on lead 32. An electrical connection 36 extends from the lead 32 to the first section 20 of the magnetic structure of the electromagnet. The connection 36 may be entirely potted within the plastic encapsulation 28. Signal output lead 38 is connected at point 40 to one of the other sections 24 of the electromagnetic core assembly. Incidentally, the non-conducting spacers or shims 42 and 44 separate the three sections 20, 22, and 24 of the magnetic core structure. Now, when the electromagnet 26 is energized by supplying power on lead 32, and when the electrically conducting magnetic strike plate 16 is in engagement with the faces of the magnetic portions 20 and 24, the circuit is closed from lead 32 to lead 38, and an electrical signal is supplied to the control unit 30, indicating both that the electromagnet 26 is energized, and also that the strike plate 16 is in firmly electrically-conducting engagement with the faces of the electromagnet.

In FIG. 3, a slightly different arrangement is provided, with leads 48 and 50 being connected respectively to core portions 20 and 24, and to core portion 22 so that the circuit between lines 48 and 50 will be closed when the strike plate 16 engages the face of the electromagnet. This closure corresponds to the closure of contacts on a conventional relay, and is therefore directly applicable to many existing electromagnetic locking system circuits.

Also, as mentioned hereinabove, instead of having the leads 48 and 50 connected respectively to different sections of the core, they may be brought up to the surface of the potted assembly, where they are machined, by grinding or the like, so that an exposed portion of the two wires would be available for electrical interconnection by the strike plate 16. These wires would preferably be similar in appearance to the pole faces of the E-shaped electromagnetic portions, and located near the ends thereof and in parallel relationship thereto, so that their purpose is camouflaged, when viewed from the exterior. Silver, or silvery colored or plated conductors may suitably be employed.

It may also be noted that the insulating shims 42 and 44 may be made of an insulating material having an appearance similar to that of the edges of the laminations forming the E-shaped cores, so that the fact that the three portions of the core are electrically insulated from one another is not readily apparent.

Figure 4:
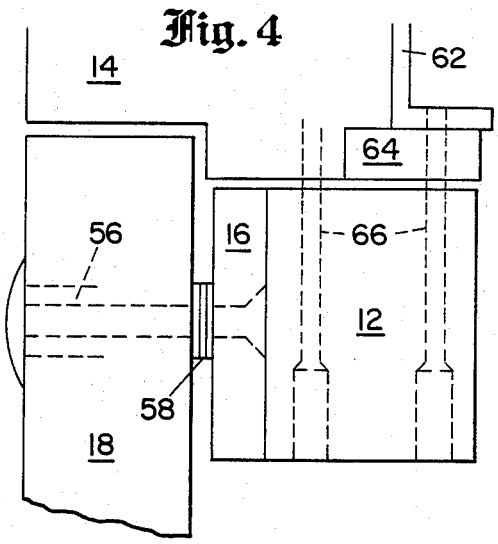
FIG. 4 is a detailed showing of a typical installation of a magnetic lock including the electromagnet and the strike plate as mounted on a door and enclosing door frame.

Now, as a matter of completeness, a conventional installation for an electromagnetically controlled door is shown in FIG. 4. More specifically, the magnetic plate 16 may be mounted for limited angular movement on the door 18 by the bolt 56 and the washer stack 58. With this type of mounting, the strike plate 16 is free to move angularly to a slight degree to make smooth flush engagement with the pole pieces of the electromagnet assembly 12. The electromagnet assembly 12 may be secured to the frame 14 in any suitable manner, including the use of the header extension angle bracket 62 and the stop filler plate 64 which may be employed under mechanical conditions where the width of the frame member 14 is insufficient for high-strength mounting of the electromagnet 12. Suitable mounting screws 66 may be employed to hold the electromagnet 12 in position.

Figure 5:
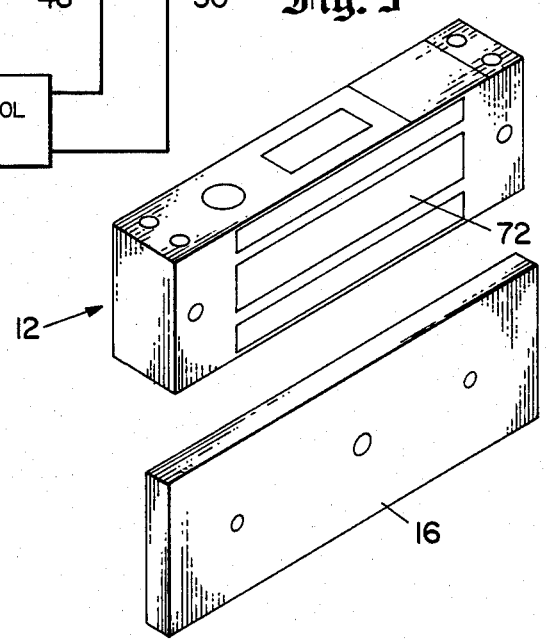
FIG. 5 shows a typical external view of an electromagnet and a strike plate.

FIG. 5 is an external view of the strike plate 16 and the electromagnet 12. Particularly to be noted in FIG. 5 are the exposed pole piece surfaces 72 of the E-shaped magnetic core portions, the internal structure of which is shown in greater detail in FIGS. 2 and/or 3.

In conclusion, it is to be understood that the foregoing description and the accompanying drawings merely relate to illustrative embodiments of the invention. Other equivalent arrangements may be employed without departing from the spirit and scope of the present invention; by way of example and not of limitation, the electromagnet locking arrangements may be employed in applications other than the control of doors, and the precise configuration of the electromagnet, the core, and the strike plate need not be precisely as shown herein. Accordingly, it is to be understood that the present invention is not limited to that precisely as shown and described in the present specification and drawings.

What is claimed is:

1. A magnetic lock and status detection system for a door or the like comprising:

an electromagnet having a core structure made of conductive magnetic material and having at least two separate core portions insulated from one another;

a magnetic strike plate made of conductive magnetic material;

means for mounting said electromagnetic and strike plate on a door and a door frame, respectively, for relative movement between a closed position wherein said strike plate engages both of said two separate core portions, and an open position wherein the door is open and said strike plate is spaced from said electromagnet;

an electrical control and sensing unit, said electrical control and sensing unit including door closure detection circuit means;

means for supplying power to said electromagnet from said electrical control and sensing unit; and electrical connections from said detection circuit means of said control and sensing unit to each of said two separate core portions;

whereby the engagement of said strike plate with said two separate core sections and the resultant closure of an electrical path between said electrical connections indicates to said detection circuit means whether the door is open or closed.

2. A magnetic lock and status detector system for a magnetic lock for a door or the like as defined in claim 1 wherein said electromagnet has an E-shaped core structure, with said core portions also being of E-shaped configuration, and being spaced from one another, and including a single electrical coil extending around the center leg all of said E-shaped core portions.

3. A magnetic lock and status detector system as defined in claim 1 including means for applying electrical power to said electromagnet and to one of said core portions in parallel, whreby a sensed output from the other core portion confirms both that the electromagnet is energized and also that the strike plate is in engagement therewith.

4. A magnetic lock and status detection system as defined in claim 1 wherein plastic means are provided for encapsulating said electromagnet with the pole pieces of said core portions.

5. A magnetic lock and status detection system for a door or the like comprising:

an electromagnet assembly including an exposed faceplate;

said electromagnet assembly including electrically insulated spaced electrically conductive members extending to said faceplate;

a magnetic strike plate made of conductive magnetic material;

means for mounting said electromagnet assembly and strike plate on two relatively movable members, for movement between a closed position wherein said strike plate engages said faceplace and an open position wherein the movable members are spaced apart from one-another and said strike plate is spaced from said electromagnet;

an electrical control and sensing unit, said electrical control and sensing unit including door closure detection circuit means;

means for supplying power to said electromagnet from said electrical control and sensing unit; and electrical connections from said detection circuit means of said control and sensing unit to each of said two separate electrically conductive members;

whereby the engagement of said strike plate with said two separate electrically conductive members and the resultant closure of an electrical path between said electrical connections indicates to said detection circuit means whether the door is open or closed.

6. A magnetic lock and status detection system as defined in claim 5 wherein said two electrically conductive members are portions of a magnetic core forming part of said electromagnet.

7. A magnetic lock and status detection system as defined in claim 5 further including means for mounting said electromagnet and said strike plate on a door and a door frame.

8. A magnetic lock and status detection system for a magnetic lock for a door or the like as defined in claim 6 wherein said electromagnetic has an E-shaped core structure, with the core portions also being of E-shaped configuration, and being spaced from one another, and including a single electrical coil extending around the center leg all of said E-shaped core portions.

9. A magnetic lock and status detector system as defined in claim 5 including means for applying electrical power to said electromagnet and to one of said electrically conductive members in parallel, whereby a sensed output from the other conductive member confirms both that the electromagnet is energized and also that the strike plate is in engagement therewith.

10. A magnetic lock and status detector system as defined in claim 6 wherein said electromagnet assembly includes plastic means for encapsulating the electromagnet.

* * * * *